US008263888B2

(12) United States Patent
Dai

(10) Patent No.: US 8,263,888 B2
(45) Date of Patent: Sep. 11, 2012

(54) POWER BUTTON ASSEMBLY AND ELECTRONIC DEVICE USING THE SAME

(75) Inventor: Bin Dai, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 420 days.

(21) Appl. No.: 12/646,852

(22) Filed: Dec. 23, 2009

(65) Prior Publication Data

US 2011/0094867 A1 Apr. 28, 2011

(30) Foreign Application Priority Data

Oct. 23, 2009 (CN) ..... 2009 1 0308743

(51) Int. Cl.
*H01H 13/70* (2006.01)

(52) U.S. Cl. ..... 200/345; 200/520; 200/296

(58) Field of Classification Search ..... 200/345
See application file for complete search history.

(56) References Cited

U.S. PATENT DOCUMENTS 6,667,447 B2 * 12/2003 Liu et al. ..... 200/5 R
8,111,522 B2 * 2/2012 Rothkopf et al. ..... 361/781

* cited by examiner

*Primary Examiner* — Renee Luebke
*Assistant Examiner* — Lheiren Mae Caroc
(74) *Attorney, Agent, or Firm* — Altis Law Group, Inc.

(57) ABSTRACT

A power button assembly includes a printed circuit board having a first surface and a second surface opposite to the first surface, a switch positioned on the first surface, a dome positioned on the second surface corresponding to the switch, a push button resiliently abutted by the dome. One can depress the push button towards the dome, which then capable of depressing the dome to activate the switch. A support plate is engaged with the printed circuit board. One of the support plate and the push button includes two pairs of hook portions, and the other includes two latching portions for engaging with the two pairs of hook portions.

9 Claims, 4 Drawing Sheets

POWER BUTTON ASSEMBLY AND ELECTRONIC DEVICE USING THE SAME

CROSS-REFERENCE TO RELATED APPLICATION

This application is related to a co-pending U.S. patent application Ser. No. 12/641,611, file on Dec. 12, 2009, and entitled "POWER BUTTON ASSEMBLY AND ELECTRONIC DEVICE USING THE SAME". The inventor of the co-pending application is Dai Bin. The co-pending application has the same assignee as the present application. The Specification and Drawings of the co-pending application is incorporated herein by reference.

BACKGROUND

1. Technical Field

The present disclosure relates to a power button assembly and an electronic device using the power button assembly.

2. Description of the Related Art

An electronic device is often provided with a power button assembly to turn a power supply on or off. A commonly used power button assembly includes a plurality of components such as a printed circuit board (PCB), a support plate, a push button, and an elastic member positioned between the push button and the PCB to generate an elastic force to abut/push against the push button. The push button may be received in an assembly hole defined in a housing of the electronic device. The PCB may engage the support plate. During assembly of the power button assembly to the housing of the electronic device, the push button is received in the assembly hole, the elastic member is positioned on one side of the push button adjacent to the PCB, and the support plate is connected to the housing to exert a set amount of elastic force acting on the push button. During assembly, the elastic member and the push button require manual positioning, which can be difficult to accurately achieve. Over time, the elastic member may loosen and supply lesser stable elastic force to push or abut against the push button, such that the operation of the power button assembly becomes more difficult.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views.

DETAILED DESCRIPTION

Figure 1:
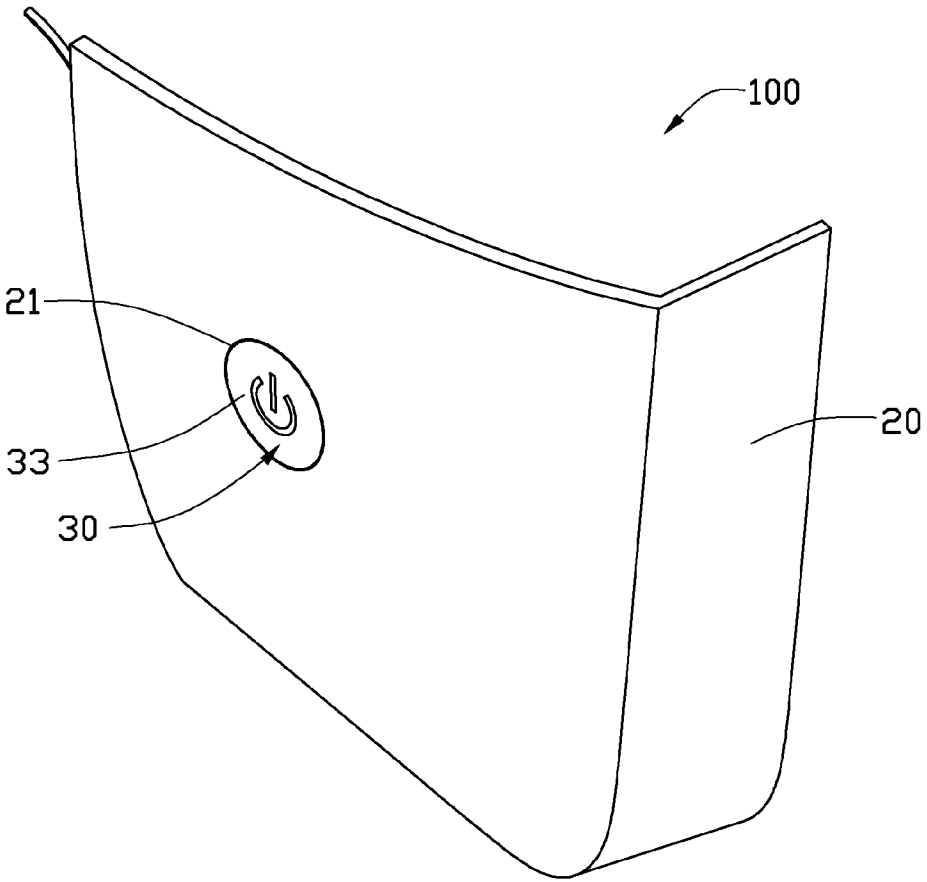
FIG. 1 is a partial, perspective view of an embodiment of an electronic device, the electronic device including a power button assembly, also as disclosed.
Figure 2:
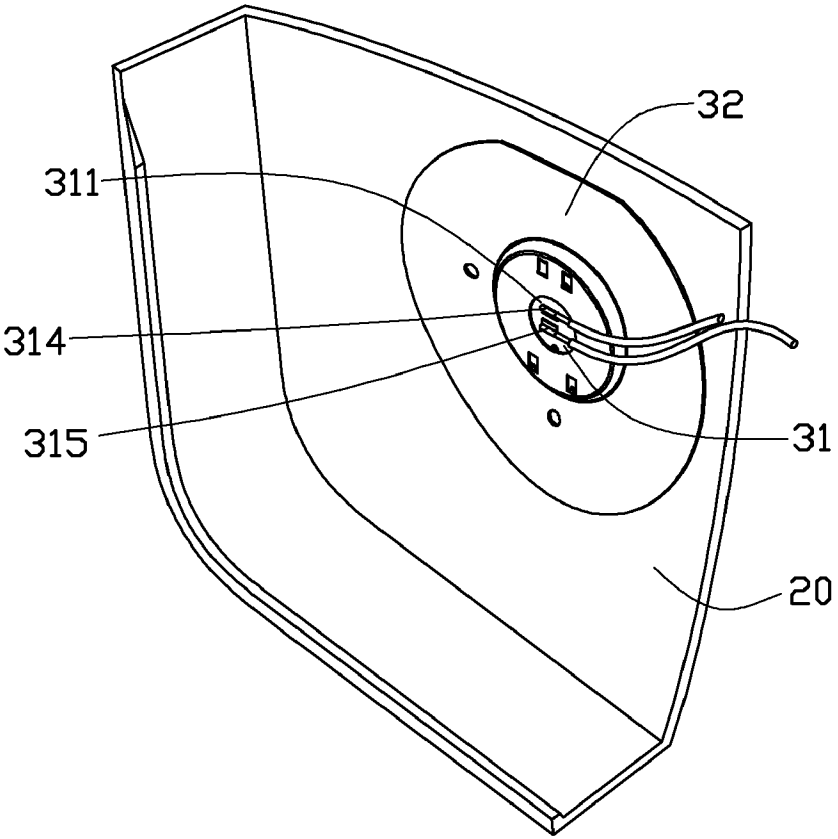
FIG. 2 is similar to FIG. 1, but is viewed from another perspective.

Referring to FIGS. 1 and 2, an embodiment of an electronic device 100 includes a housing 20 and a power button assembly 30. The housing 20 defines an assembly hole 21 therein. The electronic device 100 may be a notebook, a desktop computer, a liquid crystal display or other electronic device capable of employing the power button assembly 30.

Figure 3:
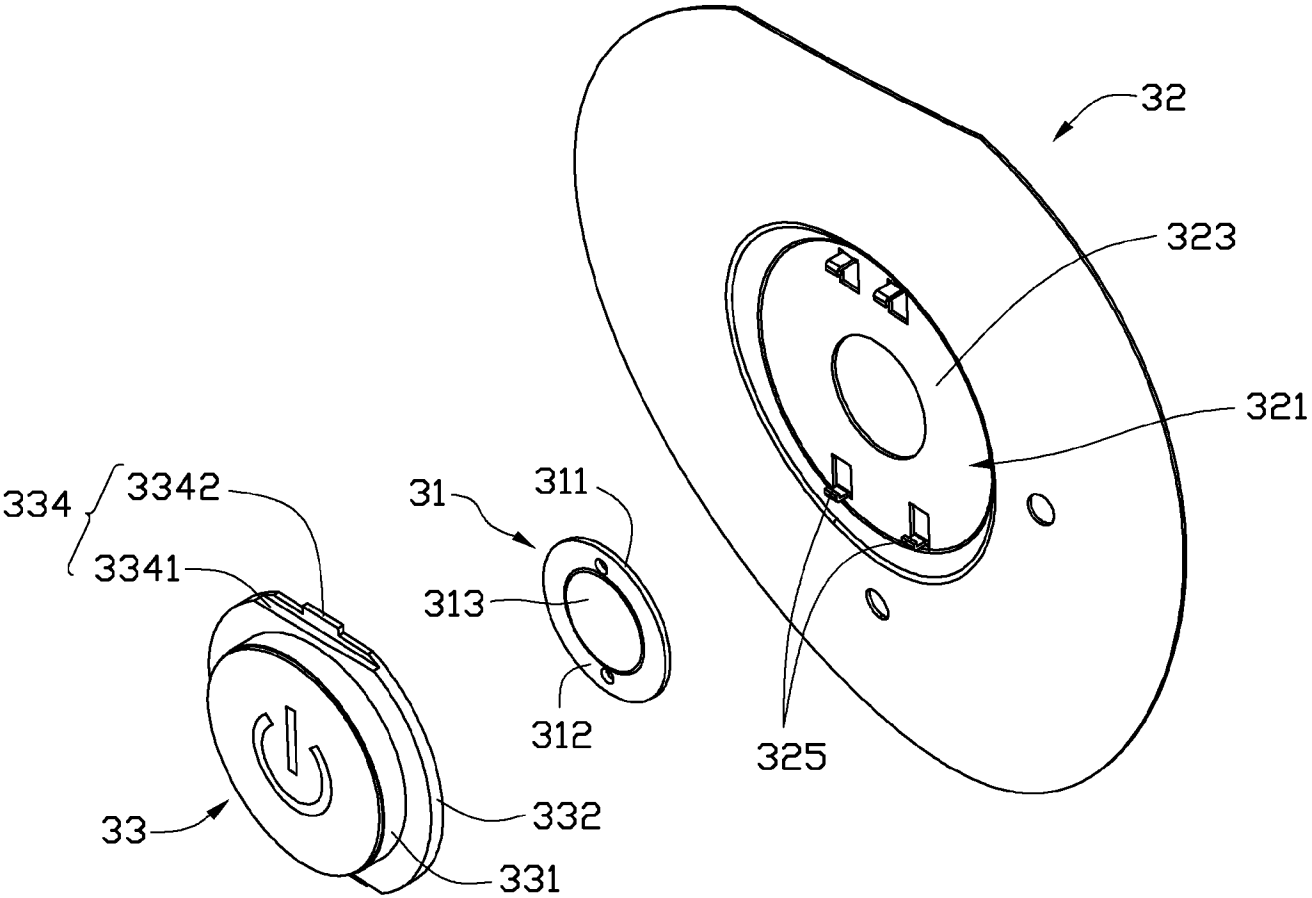
FIG. 3 is an exploded, isometric view of the power button assembly.
Figure 4:
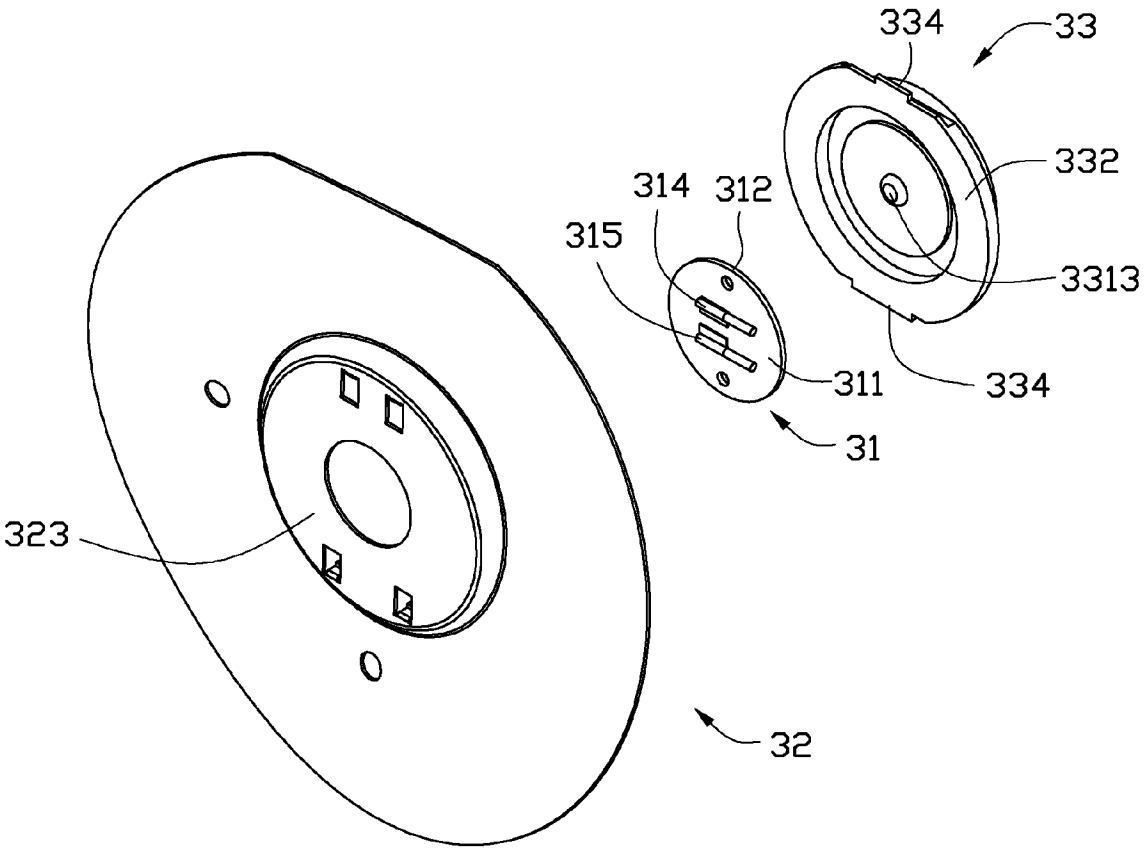
FIG. 4 is similar to FIG. 3, but is viewed from another perspective.

Referring also to FIGS. 3 and 4, the power button assembly 30 includes a printed circuit board 31, a support plate 32 engaging the printed circuit board 31, and a push button 33.

The printed circuit board 31 includes a first surface 311 and a second surface 312 opposite to the first surface 311. A switch (not labeled) is positioned on the first surface 311. A dome 313 is positioned on the second surface 312 corresponding to the switch to activate the switch. The switch includes a first electric terminal 314 and a second electric terminal 315 adjacent to the first electric terminal 314. The dome 313 is adjacent to the ends of the first and second electric terminals 314, 315, such that when the dome 313 is depressed, the first and second electric terminals 314, 315 electrically connect, thus turning the power supply on or off.

The support plate 32 is a substantially annular metal sheet. The support plate 32 defines a depression 321 in the central region thereof to receive the push button 33. The depression 321 has a bottom wall 323 on which the printed circuit board 31 is fixed. The support plate 32 can be fixed to the housing 20 by double-sided adhesive, rivet, or any other means.

A plurality of hook portions 325 are formed on the support plate 32. In the illustrated embodiment, two pairs of hook portions 325 are formed on the outer circumferential edge portion of the bottom wall 323 and extending toward the push button 33, and each pair of hook portions 325 is disposed at opposite sides in the bottom wall 323 substantially along the plane of the support plate 32, respectively. The hook portions 325 may be formed by punching or stamping, simplifying manufacture.

The push button 33 includes a cap 331 and a connecting portion 332 extending radially from the bottom edge of the cap 331. A contact portion 3313 is formed on the cap 331, and is pressed towards the dome 313 to activate the switch. Two latching portions 334 are formed on the outer circumferential edge portion of the connecting portion 332, and the latching portions 334 are opposite to each other. Each latching portion 334 includes a stepped surface 3341 and a locking portion 3342 extending outward from the edge of the stepped surface 3341.

The hook portions 325 engage with the latching portions 334, thus connecting the support plate 32 to the push button 33. In the illustrated embodiment, each latching portion 334 engages one corresponding pair of hook portions 325, with the locking portion 3342 extending between the pair of hook portions 325 to restrict the rotation of the push button 33 relative to the support plate 32, therefore allowing accurate positioning thereof.

During the assembly of the power button assembly 30, the printed circuit board 31 is fixed to the support plate 32 by rivet or screw, and the push button 33 is received in the depression 323. The hook portions 325 engage the stepped surface 3341 of the latching portion 334, and the locking portion 3342 is received between two hook portions 325, thus connecting the support plate 32 to the push button 33, with the contacting portion 3313 resiliently abutting the push button 33, such that the power button assembly 30 is easily and accurately assembled.

After the power button assembly 30 is assembled, the push button 33 can be received in the assembly hole 21 of the housing 20, and the support plate 32 can be fixed to the housing 20 by double-sided adhesive or rivet, so that the power button assembly 30 can be easily connected to the housing 20. It is unnecessary to provide dedicated hardware and manpower to assemble the power button assembly 30 in the assembly line of the electronic device 100, because the power button assembly 30 can be assembled elsewhere in advance.

In operation, as the push button 33 is depressed towards the dome 313, the contact portion 3313 elastically deforms the dome 313 which electrically connects the first and second electric terminals 314, 315 to turn the power supply on or off, and the dome 313 is being compressed and thereby accumulates an elastic force. When the push button 33 is released, the elastic force is released, and the push button 33 returns to its original position, whereby the dome 313 detaches from the first and second electric terminals 314, 315 and turns the power supply off or on.

In alternative embodiments, the hook portions 325 can be formed on the push button 33, and the latching portion 334 can be formed on the support plate 32 to engage with the hook portions 325.

It is believed that the present embodiments and their advantages will be understood from the foregoing description, and it will be apparent that various changes may be made thereto without departing from the spirit and scope of the embodiments or sacrificing all of its material advantages.

What is claimed is:

1. A power button assembly, comprising:

a printed circuit board comprising a first surface and a second surface opposite to the first surface;

a switch positioned on the first surface;

a dome positioned on the second surface corresponding to the switch;

a push button resiliently abutted by the dome, the push button being capable of depressing the dome to activate the switch; and a support plate engaging the printed circuit board; wherein the support plate comprises a plurality of pairs of hook portions, the push button comprises a plurality of latching portions, each latching portion engages a corresponding pair of hook portions, and each latching portion comprises a stepped surface engaging the corresponding pair of hook portions and a locking portion to restrict the rotation of the push button relative to the support plate.

2. The power button assembly of claim 1, wherein the support plate defines a depression in the substantially central region thereof to receive the push button.

3. The power button assembly of claim 2, wherein the depression comprises a bottom wall on which the hook portions are integrally formed.

4. The power button assembly of claim 3, wherein the push button comprises a contact portion integrally formed thereon, and the contact portion abutting the dome.

5. An electronic device comprising:

a housing defining an assembly hole therein;

a power button assembly comprising:

a printed circuit board comprising a first surface and a second surface opposite to the first surface;

a switch positioned on the first surface;

a dome positioned on the second surface corresponding to the switch;

a push button resiliently abutted by the dome and received in the assembly hole, the push button being capable of depressing the dome to activate the switch; and a support plate engaged with the printed circuit board and being fixed on the housing; wherein the support plate comprises a plurality of pairs of hook portions, the push button comprises a plurality of latching portions, each latching portion engages a corresponding pair of hook portions, and each latching portion comprises a stepped surface engaging the corresponding pair of hook portions and a locking portion to restrict the rotation of the push button relative to the support plate.

6. The electronic device of claim 5, wherein the support plate defines a depression in the substantially central region thereof to receive the push button.

7. The electronic device of claim 6, wherein the depression comprises a bottom wall on which the hook portions are integrally formed.

8. The electronic device of claim 5, wherein the push button comprises a contact portion integrally formed thereon, and the contact portion abutting the dome.

9. The electronic device of claim 5, wherein the support plate is fixed on the housing by double-sided adhesive.

* * * * *